US007922641B2

(12) United States Patent
Maddaleni et al.

(10) Patent No.: US 7,922,641 B2
(45) Date of Patent: Apr. 12, 2011

(54) MACHINE FOR THE PRODUCTION OF TUBES BY WINDING STRIPS OF WEBLIKE MATERIAL

(75) Inventors: Romano Maddaleni, Pisa (IT); Giancarlo Cicalini, Lucca (IT); Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 317 days.

(21) Appl. No.: 12/086,857

(22) PCT Filed: Dec. 19, 2006

(86) PCT No.: PCT/IT2006/000857

§ 371 (c)(1),
(2), (4) Date: Jun. 20, 2008

(87) PCT Pub. No.: WO2007/072531

PCT Pub. Date: Jun. 28, 2007

(65) Prior Publication Data

US 2010/0222194 A1 Sep. 2, 2010

(30) Foreign Application Priority Data

Dec. 23, 2005 (IT) ..... FI2005A0258

(51) Int. Cl.
*B31C 11/02* (2006.01)

(52) U.S. Cl. ..... 493/288; 493/289; 493/298; 493/304

(58) Field of Classification Search ..... 493/288, 493/289, 290, 298, 299–302, 304
See application file for complete search history.

(56) References Cited

U.S. PATENT DOCUMENTS

| | | | | | |
|---|---|---|---|---|---|
| 1,709,369 | A | * | 4/1929 | Wesley | 83/286 |
| 2,168,203 | A | * | 8/1939 | Green | 82/48 |
| 2,600,254 | A | | 6/1952 | Lysobey | |
| 3,397,625 | A | * | 8/1968 | Leonard | 493/289 |
| 3,942,418 | A | * | 3/1976 | Smith | 493/11 |
| 4,220,077 | A | * | 9/1980 | Miller et al. | 493/11 |
| 4,258,613 | A | * | 3/1981 | Fegley et al. | 493/22 |
| 4,299,147 | A | * | 11/1981 | Rogers | 82/47 |
| 4,370,140 | A | * | 1/1983 | Fegley et al. | 493/289 |
| 4,378,966 | A | * | 4/1983 | Schumacher | 493/22 |
| 4,889,023 | A | * | 12/1989 | Languillat | 82/92 |
| 4,934,225 | A | * | 6/1990 | Languillat et al. | 82/53.1 |
| 5,086,677 | A | * | 2/1992 | Languillat | 82/92 |
| 5,111,721 | A | * | 5/1992 | Languillat | 82/47 |
| 5,468,207 | A | * | 11/1995 | Bower et al. | 493/297 |
| 5,593,375 | A | | 1/1997 | Franci | |
| 5,873,806 | A | * | 2/1999 | Biagiotti | 493/290 |
| 6,012,369 | A | * | 1/2000 | Abbey, III et al. | 83/382 |

FOREIGN PATENT DOCUMENTS

| | | | |
|---|---|---|---|
| BE | 1 004 992 | A6 | 3/1993 |
| IT | 1 204 029 | B | 3/1989 |
| WO | WO 2004/101265 | A1 | 11/2004 |
| WO | WO 2004/106017 | A1 | 12/2004 |

* cited by examiner

*Primary Examiner* — Hemant M Desai
(74) *Attorney, Agent, or Firm* — Breiner & Breiner, L.L.C.

(57) ABSTRACT

The machine for producing tubes includes a winding spindle around which strips of weblike material are wound to form the tube, which is made to advance along the spindle; a device for supply and winding of the strips around the spindle, and at least one knife for cutting lengths of the tube being formed. The knife is provided with a reciprocating movement parallel to the spindle. There is moreover envisaged a counter-knife within the tube being formed, provided with a movement of translation synchronized to the movement of translation of the knife. The counter-knife is magnetically constrained to a mover member, which transmits the motion to the counter-knife.

18 Claims, 2 Drawing Sheets

MACHINE FOR THE PRODUCTION OF TUBES BY WINDING STRIPS OF WEBLIKE MATERIAL

This application is the U.S. national phase of PCT application PCT/IT2006/000857 filed on Dec. 19, 2006, with a claim to the priority of Italian application FI2005A000258 filed on Dec. 23, 2005.

TECHNICAL FIELD

The present invention relates to a core-winder, i.e. a machine for the production of tubes by winding one or more strips of weblike material, e.g. set on top of one another and partially staggered in a helically shaped arrangement, or in a longitudinal arrangement.

BACKGROUND OF THE INVENTION

Machines of this type are commonly used for the production of tubes of cardboard or other sheet material on which to wind weblike material, such as paper, tissue paper, plastic film, aluminium sheets or the like. These tubes are usually circular in cross-section. Tubes thus produced can also have different shapes and cross sections, such as circular, square, rectangular, or other. Such tubes can be used not only as winding cores for the formation of rolls or logs of weblike material, but can also be designed for various different applications, as containers for foodstuff products, for soap powders, or for other applications. In sequel the present description reference will be made to the formation of circular tubes used as winding cores for weblike materials; however, the scope of protection of the present invention is not limited to this application, but it is understood as extending to all the sectors that regard formation of tubes from one or more wound strips of weblike material.

Winding of the weblike material can be obtained by winding one or more strips helically around the forming spindle, as represented and described with reference to the example of embodiment illustrated in what follows, or else they can be obtained by feeding longitudinally two or more strips that overlap one another until their sides are mated and wrap the forming spindle, as for example represented and described in WO-94/20281 (corresponding to U.S. Pat. No. 5,593,375).

Consequently, by the term "winding" it is to be Understood that the strips of weblike material can coat or wrap the forming spindle, it being possible for them to be fed to the latter either obliquely with respect to the axis of the spindle (helical winding), or else parallel to said axis (longitudinal winding). Consistently, a core-winder, machine for the production of tubes, or tube-forming machine should be understood as any machine in which strips of weblike material are wound around a mandrel to continuously form a tubular article of manufacture, such a winding cores, prismatic or cylindrical boxes and the like. Weblike material can be a cardboard strip, a plastic strip, or a strip of any other suitable material, depending upon the article of manufacture to be produced therewith. The web-like material strips can be adhered to one another by means of glue, adhesive, or any kind of bonding agent, by means of welding, such as ultrasound welding, or in any other suitable manner.

For the production of tubes of cardboard or other material via helical winding of one or more strips set staggered on top of one another a core-winder machine is used, typically comprising: a winding spindle, around which are wound helically the strip or strips to form the tube continuously, which is made to advance along the spindle; a device for supply and winding the strips around the spindle; at least one knife for cutting individual lengths of said tube being formed, which knife is provided with a reciprocating movement parallel to the spindle; a counter-knife within the tube being formed, provided with a movement of translation synchronized to the movement of translation of the knife.

A core-winder of the above type is described, for example, in U.S. Pat. No. 5,873,806. Other machines for helical winding of strips are described in U.S. Pat. Nos. 2,502,638, 2,623,445, 3,150,575, 3,220,320, 3,636,827, 3,942,418, 4,378,966, as well as in WO-A-2004101265 and WO-A-2004106017.

In these machines, the tube is formed continuously by winding of two or more strips of weblike material, for example paper or cardboard, staggered with respect to one another, around the winding spindle, which is mounted in cantilever fashion, either fixed or able to turn (preferably idle).

Irrespective of how the strips of weblike material are wound and adhered to one another, a continuous tube is usually produced, which must be cut into individual lengths that are designed for the final use, for example for winding of paper for the production of rolls. Cutting is executed with one or more disk-shaped knives that can be motor-driven or else idle and drawn in rotation by friction with the tube. The cutting edge of the knives can be smooth or serrated according to the configuration of the machine. The knives have an axis of rotation parallel to the axis of the spindle and hence of the tube being formed and are pressed against the outer cylindrical surface of the tube and advance together therewith parallel to the axis of the forming spindle. Usually, during rotation and advance of the tube, the cut is performed by the knife or knives according to a cutting plane orthogonal to the axis of the tube being formed. Once cutting has been completed, the knife is moved away from the axis of the tube and brought back into the position in which the next cut will start.

Usually, provided within the tube being formed is a counter-knife, with which the knife or knives set on the outside of the tube co-operate. Said counter-knife must follow the movement of the knife or knives during cutting and hence must advance in synchronism with the tube being formed up to completion of the cut and then come back into the position in which also the knife or knives move back to start the next cut. In some machines this movement is obtained by setting the counter-knife on a guide rod constituting a prolongation of the forming spindle and constraining the counter-knife temporarily to the knife as a result of the force of friction that is generated by pressing the knife on the material to be cut. In this way, the counter-knife advances together with the knife. When the latter is moved away from the tube, the counter-knife is recalled by a spring into its initial position.

The above constructively simple solution is not very reliable and entails in any case high pressure stresses between the knife and the counter-knife so that forces of friction will be generated sufficient to draw the counter-knife in the synchronous movement of advance with the knife. The aforesaid solution can moreover be critical in the case of particularly rigid tubes.

Furthermore, the return spring is frequently subject to failure due to fatigue, in so far as it must perform, in more modern machines, a travel of approximately 150 mm in every tenth of a second.

Other and more complex solutions envisage a positive system that advances the counter-knife during cutting and brings it back into its initial position during retraction of the knife.

OBJECTS AND SUMMARY OF THE INVENTION

An object of the present invention to provide a machine for the production of tubes from continuous wound strips, i.e., a so-called core-winder, that has a simpler and more reliable counter-knife, and that will overcome totally or in part the drawbacks of known systems for the advance and retraction of the counter-knife in synchronism with the tube-cutting knife.

The above and further objects and advantages that will emerge clearly to persons skilled in the art from the ensuing text are obtained basically by a core-winder of the type described above, in which the counter-knife is constrained magnetically to a mover member that transmits the motion of translation to said counter-knife.

In a preferred embodiment, the counter-knife is mounted in tandem to annular-shaped magnets, which, as a result of the magnetic field generated by them, are constrained to a mover member, which is also provided with magnets, transmitting the motion of translation to the counter-knife.

The magnetic coupling between the mover member and the counter-knife avoids the need for spring return members and also for mechanical connections for drawing the counter-knife in synchronous movement with the knife. In general, the mover member could also be set within a guide or a prolongation of the spindle, on which the counter-knife is fitted. In this case, the mover member will be controlled in a synchronized way with the reciprocating movement of translation of the knife, for example via an electronic coupling.

According to a particularly advantageous embodiment, the mover member is located on the outside of the tube being formed, and the coupling is obtained via interaction of magnetic fields through the thickness of the tube. The mover member can be independent of the knife and simply brought into synchronous movement with the knife. Preferably, however, in an embodiment that is particularly simple from the constructional point of view, the mover member is fixed with respect to a carriage that carries the knife. In this way, the mechanism that controls the movement of advance and retraction of the knife synchronized with the movement of advance of the tube being formed serves at the same time to bring about a synchronized movement of the counter-knife, without any need for auxiliary members or mechanisms.

According to a preferred embodiment, then, the knife is supported by a mobile carriage with reciprocating motion parallel to the spindle. On the carriage, first magnets are set adjacent to the tube being formed, and the counter-knife is constrained to second magnets inside said tube, the magnetic fields of said first and second magnets interacting so that the counter-knife is drawn magnetically by the carriage that supports the knife.

In a practical embodiment, the counter-knife is carried by a slider that can slide on a guide rod fixed with respect to the spindle and coaxial thereto. The slider and the counter-knife are able to rotate about the axis of the guide rod and of the spindle. In this case, between the counter-knife and the slider there cannot be relative movement. The rod will have a circular cross section to enable rotation of the slider. Not excluded, however, is the possibility that the slider will be torsionally constrained to the rod, for example, envisaging that the latter will have a polygonal cross section. In this case, the counter-knife that appropriately rotates about the axis of the spindle and of the rod will be supported so that it can turn on the slider, for example with the interposition of a bearing.

Above all in the case where the slider is able to turn around the guide rod, it is advantageous to envisage that the magnets fixed thereto are annular in shape.

In general, the magnets can be electromagnets, but will preferably be permanent magnets.

In an advantageous embodiment, the magnets that are located on the outside of the tube are carried by an annular structure fixed with respect to the carriage and surrounding the axis of said spindle. With this structure, it is possible to arrange the magnets about the axis of the spindle.

BRIEF DESCRIPTION OF THE DRAWINGS

The invention will be understood more clearly from the description and the attached drawings, which show a practical non-limiting embodiment of the invention. More in particular, in the drawings.

DETAILED DESCRIPTION OF AN EMBODIMENT OF THE INVENTION

Figure 1:
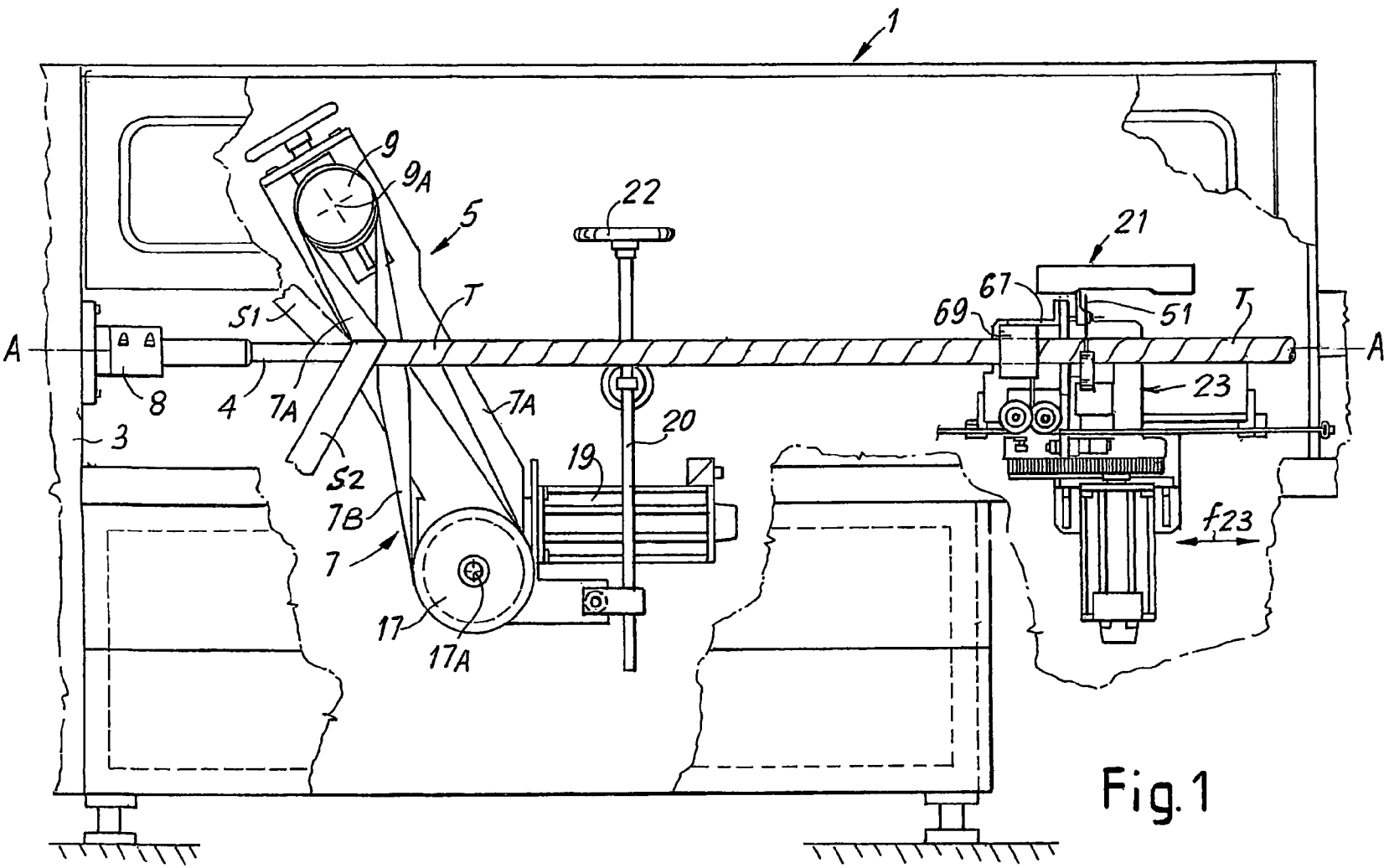
FIG. 1 is a side view of a core-winder on which the invention can be implemented.

FIG. 1 shows as a whole a possible embodiment of a core-winder, to which the present invention is applied. It should, on the other hand, be appreciated that the invention can be applied also to machines of different structure, provided that they are equipped with a winding spindle for the formation of the tubes, which can be fixed or else rotary (advantageously supported idle) about its own axis, and that they call for a device for cutting, into lengths or tubular portions of given length, the tube that is formed continuously around the spindle.

In brief, and limitedly to what concerns the present description, the machine of FIG. 1, designated as a whole by 1, comprises a load-bearing structure 3, by which a spindle 4 is supported in cantilever fashion, a first end of which is constrained to the load-bearing structure 3 via a sleeve 8. The opposite end of the spindle 4 terminates in the proximity of the area in which the tube is cut. A conveyor or equivalent means (not shown) then moves away the individual tubular products obtained by cutting a tube T, formed continuously as described herein around the spindle 4.

To form the tube T, one or more strips made of cardboard or other continuous weblike material are fed to the core-winder 1. In the example shown, two strips designated by S1 and S2 are used. These are fed and wound helically around the spindle 4 with the aid of a feeding and winding device 5 comprising, in the example illustrated, a continuous belt 7, which has two branches 7A and 7B, entrained by two pulleys 9 and 17, the respective axes of rotation of which are designated by 9A and 17A. The branch 7A forms a helical turn around the spindle 4 and around the strips of weblike material S1 and S2 in the course of winding. Designated by 19 is the motor that carries the drive pulley 17, which causes movement of the belt 7, in rotation.

The inclination of the unit formed by the pulleys 9, 17, the belt 7 and the motor 19 is adjustable via a threaded bar 20 and a handwheel 22, to adjust the inclination of the helical turns formed by the two strips S1, S2 about the axis of the spindle 4.

The two strips S1 and S2 are wound set on top of one another and staggered, so that on a helix formed by the turns of the inner strip S2 there overlaps, with a staggering for example of half a pitch, a helix formed by the turns of the outer strip S1.

On the inner surface of the outer strip S1 and/or on the outer surface of the inner strip S2 there is applied, in a way known per se and not shown, a glue to cause the two strips to adhere to one another.

The tube T is produced continuously and must then be cut into portions of the desired length. For this purpose a cutting device is provided, as a whole designated by 21, set downstream of the winding system 7, 9, 17, 19 with respect to the direction of supply fT of the tube along the winding spindle 4.

The cutting device 21 represented in FIG. 1 can be built in any known way. For example, it can be of the type described in detail in U.S. Pat. No. 5,873,806, which is entirely incorporated herein by reference. It should, on the other hand, be understood that the cutting device used can also be of another type, provided that it is equipped with at least one knife, preferably a disk-shaped knife turning about an axis parallel to the axis of the spindle 4 which, in FIG. 1, is indicated by A-A. The specific configuration of the cutting device is not of interest here. Let it suffice to note that it comprises a carriage 23 provided with a reciprocating motion as indicated by the double-headed arrow f23 parallel to the axis A-A of the winding spindle 4. This movement enables cutting of the continuous tube T into individual lengths to be carried out without stopping advance of the tube itself that is generated continuously as a result of the supply of the strips S1, S2 and of the rotation of the pulleys 9, 17. As is known, the cutting knife or knives are pressed radially against the tube T being formed when the carriage 23 is located in a position of start of cutting. The carriage is then made to advance parallel to the spindle 4 for a travel equal to the advance of the tube T being formed during the time necessary for execution of the cut. In practice, the tube T must perform at least one complete revolution about its own axis to complete the cut when this is executed with a single knife. A smaller travel can be provided when the cut is executed, for example, with two knives, as specifically illustrated in the example of embodiment and described in the document No. U.S. Pat. No. 5,873,806, in so far as in this case a rotation of 180° of the tube about its own axis is sufficient to complete cutting of the length of tube.

Figure 2:
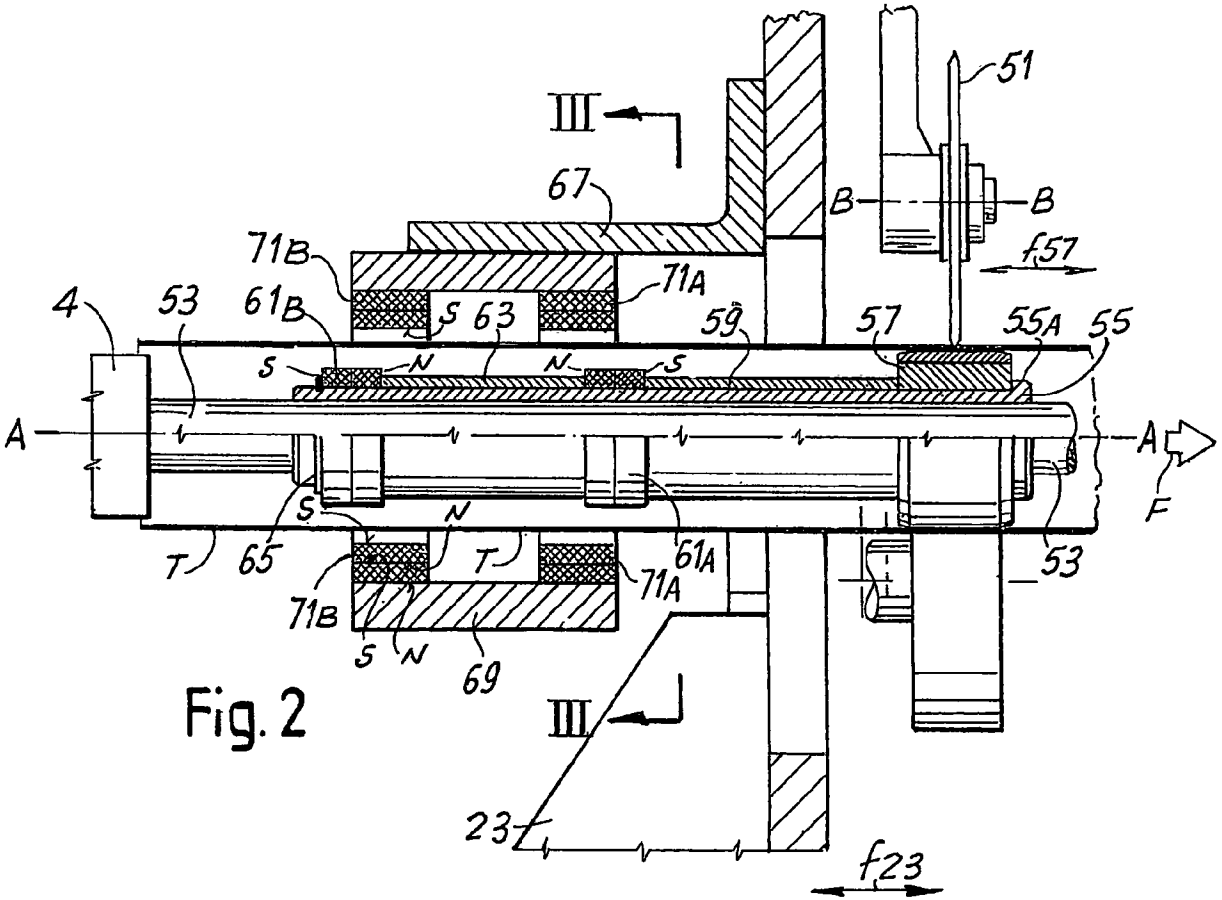
FIG. 2 shows a longitudinal cross section in a plane containing the axis of the spindle, in a position corresponding to the area of cutting of the tube.
Figure 3:
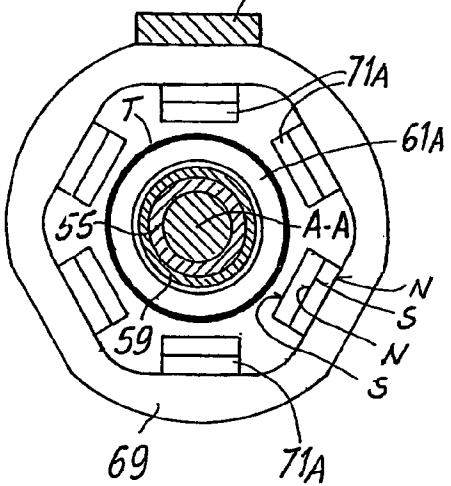
FIG. 3 shows a schematic and simplified view according to III-III of FIG. 2.

The characteristics that form a specific subject of the embodiment of the invention illustrated herein are shown in FIGS. 2 and 3. In particular, in the longitudinal cross section of FIG. 2 the area of action of the disk-shaped knife, schematically designated by 51, and of which B-B indicates the axis of rotation, is visible. The knife can be either an idle or motor-driven knife. Designated by 23 is again the knife-supporting carnage.

Within the tube T that advances continuously according to the arrow F there extends a guide rod constituting a prolongation of the winding spindle 4 and having hence an axis coinciding with the axis of said spindle. Fitted on the rod 53, which in this embodiment has a circular cross section, is a slider 55, made for example of low-friction synthetic material, such as PTFE (or Teflon®) or the like. Fitted in sequence on the slider 55, which has an annular contrast element 55A, are the following components starting from the annular contrast element 55A itself towards the left (as viewed in the drawing): an annular counter-knife 57; a spacer 59; a pair of annular magnets 61A; a second spacer 63; a further pair of annular magnets 61B; and an elastic lock ring 65. Indicated in the drawing are the poles N and S of the two pairs of annular magnets 61A and 61B. The faces set alongside one another of the annular magnets of each pair have opposite polarities. It is to be appreciated that the polarities may also be reversed with respect to what is indicated, but typically the pairs of magnets 61A and 61B are mounted with the same poles facing one another, so as to tend to repel each other.

Fixed with respect to the carriage 23 is a bracket 67, which carries an annular element 69 surrounding the axis A-A of the spindle 4, of the guide rod 53, and of the tube T being formed around the spindle itself. This element or annular structure carries, distributed about the axis A-A of the spindle 4, pairs of magnets 71A and 71B. The ensemble formed by the elements 67, 69, 71 forms a mover member to bring about movement of the counter-knife. In the preferred embodiment illustrated herein, each of these magnets has a prismatic configuration, i.e., a plate-shaped configuration, even though different configurations, for example annular ones, are not excluded. In the example shown, six pairs of magnets 71A, 71B are provided, the polarities of which are indicated in the drawing by N and S.

In this embodiment, each magnet 71A, 71B has its South pole S facing inwards, i.e., in the position radially closer to the guide rod 53 and to the pairs of annular magnets 61A, 61B, and its North pole N facing outwards. Different configurations are not excluded. In this configuration the magnetic fields of the magnets 71A, 71B and of the pairs of magnets 61A, 61B are such that, thanks to the forces of mutual repulsion and attraction between magnets, the slider 55 to which the annular magnets 71A, 71B are fixed is drawn by the carriage 23 during its movement indicated by the double-headed arrow f23.

The arrangement is hence such that the counter-knife 55 follows the knife 51 during the movement of advance, with the knife 51 in the cutting position, as shown in FIG. 2, and in the movement of retraction, once cutting of a length of tube T is completed, towards the position of start of the next cut. The counter-knife 57 thus remains always in the right position to co-operate with the knife 51. With the arrangement of the magnets as shown, the influence is avoided of the magnets themselves on the counter-knife, which, though being made of metal material, is free to rotate. The magnets are in fact at a distance from the knife.

The magnetic coupling between the counter-knife 57, fixed with respect to the slider 55, and the carriage 23 is sufficient to guarantee the reciprocating movement in the direction f57 of the counter-knife 57 in synchronism with the movement in the direction f23 of the knife 51 and of the carriage 23 that carries it.

it should be appreciated that what is illustrated is only one example of the more general inventive idea illustrated above and defined in greater detail in the attached claims. In particular, the structure of the core-winder can even be substantially different from the one illustrated. The conformation of the pairs of magnets 61A, 61B, as well as 71A, 71B, can be different from the one illustrated. For example, it is possible to use magnets of shapes and dimension different from the ones described and represented. Advantageously, the arrangement of the polarity of the magnets mounted on the slider will be orthogonal to the arrangement of the polarity of the magnets mounted on the mover member. The number of the cutting knives, their conformation in particular as regards the motor drive, which can be present or absent, the configuration of the cutting edge and other features are not critical for the implementation of the present invention, even though it is preferable to use knives supported in an idle way about their own axis B-B and provided with a smooth cutting edge, instead of a serrated one. The counter-knife 57 can be made of any suitable material and have, for example, an interchangeable part or be completely interchangeable for replacement in the case of wear.

For certain applications, the counterknife 57 can have a slightly different function, i.e., only of support to the piece to be cut without function of contrast to the knife. In these cases; the tube to be cut is again supported internally by the forming spindle, the terminal part of which is mobile axially to follow the sliding and cutting of the tube. The knife can carry out a shearing cut or preferably can be serrated turning at a high speed and cutting the tube by penetrating therein. In these applications, the spindle terminates with a sliding bushing, which, at the moment of cutting, slides axially to follow the cutting edge of the knife and prevent the tube from collapsing or in any case being deformed by the action of the blade.

These cutting systems are valid for all types and shapes of tube to be cut and in particular for tubes of a shape different from the circular one and/or for large thickness of the weblike material that is wound. The possibility of using sliding bearings that reduce the friction between the slider 55 and the guide rod 53 is not excluded. On the other hand, in the preferred embodiment illustrated herein, the slider 55 is made of low-friction material that guarantees a sufficient reduction of the forces of friction between the guide rod 53 and the slider itself.

A further embodiment envisages, for cutting tubes formed by longitudinal winding, that the knife or knives turn around the tube being formed. In this case, the counter-knife translates, without turning the tube that is being formed.

The shape and arrangement of the polarities of the magnets can vary with respect to what has been illustrated. What is important is that they should be able to exert a force of mutual attraction such as to draw the counter-knife in reciprocating motion parallel to the axis of the spindle. If the machine is configured in such a way that the counter-knife must rotate together with the tube being formed, the shape and polarities of the magnets will be such as not to hinder significantly the movement of rotation.

It is understood that the drawings merely show one example of embodiment, provided only as a practical illustration of the invention, given that the invention can vary in shapes and arrangements, without thereby departing from the scope of the idea underlying the invention itself.

The invention claimed is:

1. A machine for producing tubes by winding strips of web material, comprising:

a winding spindle, around which are wound said strips to form said tube that is made to advance along said spindle;

a device for supplying and winding said strips around said spindle;

at least one knife for cutting lengths of said tube being formed, said knife being provided with a reciprocating movement parallel to said spindle; and a counter-knife within the tube being formed, provided with a movement of translation synchronized with a movement of translation of said knife; wherein said counter-knife is constrained magnetically to a mover member that transmits the movement of translation to said counter-knife;

wherein said knife is supported by a mobile carriage with reciprocating motion parallel to said spindle; and wherein said mover member is fixed with respect to the carriage that supports the knife.

2. The machine according to claim 1, further comprising first magnets arranged on said carriage, said first magnets being arranged on an outside of the tube being formed and adjacent thereto; and second magnets constrained to said counter-knife arranged inside said tube, wherein magnetic fields of said first magnets and said second magnets interact so that the counter-knife is drawn magnetically by the carriage that supports the knife.

3. The machine according to claim 2, wherein said first magnets are set with polarities oriented according to a direction orthogonal to a direction of alignment of polarity of said second magnets.

4. The machine according to claim 3, wherein said first magnets and said second magnets are configured and set such that force of mutual attraction between the first magnets and the second magnets does not hinder rotation of the counter-knife about an axis of the spindle.

5. The machine according to claim 2, wherein said first magnets and said second magnets are configured and set such that force of mutual attraction between the first magnets and the second magnets does not hinder rotation of the counter-knife about an axis of the spindle.

6. The machine according to claim 2, wherein said counter-knife is carried by a slider constructed and arranged to slide on a guide rod fixed with respect to the spindle and coaxial thereto.

7. The machine according to claim 1, wherein said counter-knife is carried by a slider constructed and arranged to slide on a guide rod fixed with respect to the spindle and coaxial thereto.

8. The machine according to claim 7, wherein said slider and said counter-knife are able to rotate freely about an axis of the guide rod.

9. The machine according to claim 7, wherein said counter-knife is constructed and arranged to turn with respect to said slider.

10. The machine according to claim 1, wherein said second magnets are annular.

11. The machine according to claim 1, wherein said second magnets are permanent magnets.

12. The machine according to claim 1, wherein said first magnets are permanent magnets.

13. The machine according to claim 1, wherein said first magnets are carried by an annular structure fixed with respect to said carriage and surrounding the axis of said spindle.

14. The machine according to claim 13, wherein said first magnets are set about the axis of the spindle.

15. The machine according to claim 1, wherein said first magnets have a plate-like configuration.

16. The machine according to claim 1, wherein said first magnets are set in pairs.

17. The machine according to claim 1, wherein said second magnets are set in pairs.

18. The machine according to claim 1, wherein said first magnets and said second magnets are set at a distance from said knife.

* * * * *